United States Patent [19]

Magnussen, Jr.

[11] Patent Number: 4,605,127

[45] Date of Patent: Aug. 12, 1986

[54] FRESH FRUIT PACKAGING

[76] Inventor: Robert O. Magnussen, Jr., 20442 Lake Canyon Dr., Walnut, Calif. 91789

[21] Appl. No.: 727,232

[22] Filed: Apr. 25, 1985

Related U.S. Application Data

[63] Continuation-in-part of Ser. No. 698,119, Feb. 4, 1985, Pat. No. 4,556,147.

[51] Int. Cl.[4] ..... B65D 77/00

[52] U.S. Cl. ..... 206/525; 206/499; 206/493; 229/2.5 R

[58] Field of Search ..... 206/525, 499, 45.33, 206/493; 220/4 E; 229/2.5 R

[56] References Cited

U.S. PATENT DOCUMENTS

| | | | |
|---|---|---|---|
| 1,916,037 | 6/1933 | Carlsen | 206/499 |
| 2,663,450 | 12/1953 | Bourcart | 206/499 |
| 2,893,550 | 7/1959 | Sandmeyer | 206/499 |
| 3,121,511 | 2/1964 | Whitehead | 206/499 X |
| 3,365,308 | 1/1968 | Janicke | 206/525 |
| 3,451,328 | 6/1969 | Swett | 150/55 |
| 3,498,525 | 3/1970 | Zinkgraf | 229/43 |
| 3,529,531 | 9/1970 | Swett | 220/355 |
| 4,243,140 | 1/1981 | Thrun | 229/2.5 R |
| 4,556,147 | 12/1985 | Magnussen, Jr. | 206/493 |

*Primary Examiner*—Steven M. Pollard
*Attorney, Agent, or Firm*—William W. Haefliger

[57] ABSTRACT

Packaging for fresh fruit characterized as having a lower surface forming an upward, re-entrant recess, the packaging comprising (a) upper and lower container sections to receive said fruit, (b) first locating means on the container lower section to project upwardly into said recess, thereby to position the lower extent of the fruit, limiting its sideward movement relative to the container, (c) and second locating means on the container upper section to engage the upper extent of the fruit, thereby to position same limiting its sideward movement relative to the container.

10 Claims, 6 Drawing Figures

FRESH FRUIT PACKAGING

BACKGROUND OF THE INVENTION

This application is a continuation-in-part of my prior application Ser. No. 698,119, filed Feb. 4, 1985, now U.S. Pat. No. 4,556,147.

This invention relates generally to packaging of fruit, and more particularly to a protective package for individual pieces of fruit, such as single apples.

The expense and handling of fruit, and especially prime apples, for example, creates a need for their protection, as during transport and other handling prior to reception by the consumer. Also, protective gift packaging or packaging for other purposes is frequently needed.

SUMMARY OF THE INVENTION

It is a major object of the invention to provide a unique, attractive, efficient and inexpensive package for individual pieces of fruit, such as apples, for example. Such fruit typically has one or more surfaces providing re-entrant recesses. Basically, the package of the invention comprises:

(a) upper and lower container sections to receive said fruit, (b) first locating means on the container lower section to project upwardly into said recess, thereby to position the lower extent of the fruit, limiting its sideward movement relative to the container, (c) and second locating means on the container upper section to engage the upper extent of the fruit, thereby to position same limiting its sideward movement relative to the container. Typically, the container sections are sized to closely surround the fruit, in spaced relation thereto; the container sections are cup-shaped and have rim portions which are joined together; and fruit is positioned in the container sections by the first and second locating means, in closely spaced relation to the container wall surrounding the fruit. The fruit may consist of an apple, and the container sections may consist of thin walled, molded synthetic resin.

It is a further object of the invention to provide the second locating means to have a centrally located conical projection on the section top wall to downwardly enter a re-entrant recess defined by the upper extent of said fruit. Likewise, the first locating means may have a centrally located, generally conical projection to upwardly enter the lower re-entrant recess; and that projection may be integral with the container bottom wall, these features providing essential simplicty of construction of the package.

These and other objects and advantages of the invention, as well as the details of an illustrative embodiment, will be more fully understood from the following specification and drawings, in which:

DRAWING DESCRIPTION

DETAILED DESCRIPTION

Figure 1:
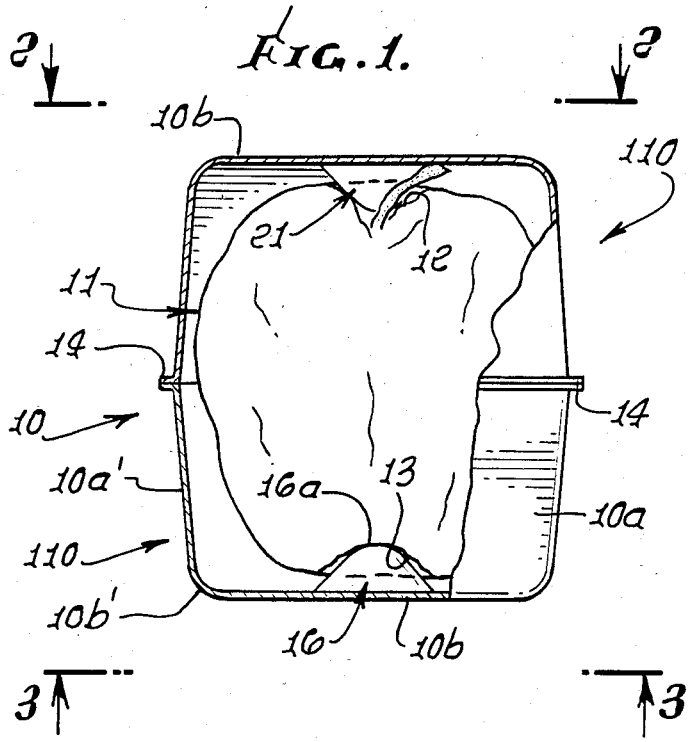
FIG. 1 is a side elevation showing a package incorporating the invention.

Package 10 shown in the drawings is especially adapted in its construction for safe, protective encapsulation or retention of fresh fruit, as for example an apple 11. The latter has bulbous side surface 11*a*, an annularly upwardly convex top surface 11*b*, and an annularly downwardly convex bottom surface 11*c*. The top surface 11*b* forms a downwardly re-entrant, generally centrally recess 12; and the bottom surface 11*c* forms an upwardly re-entrant, generally central recess 13.

Figure 4:
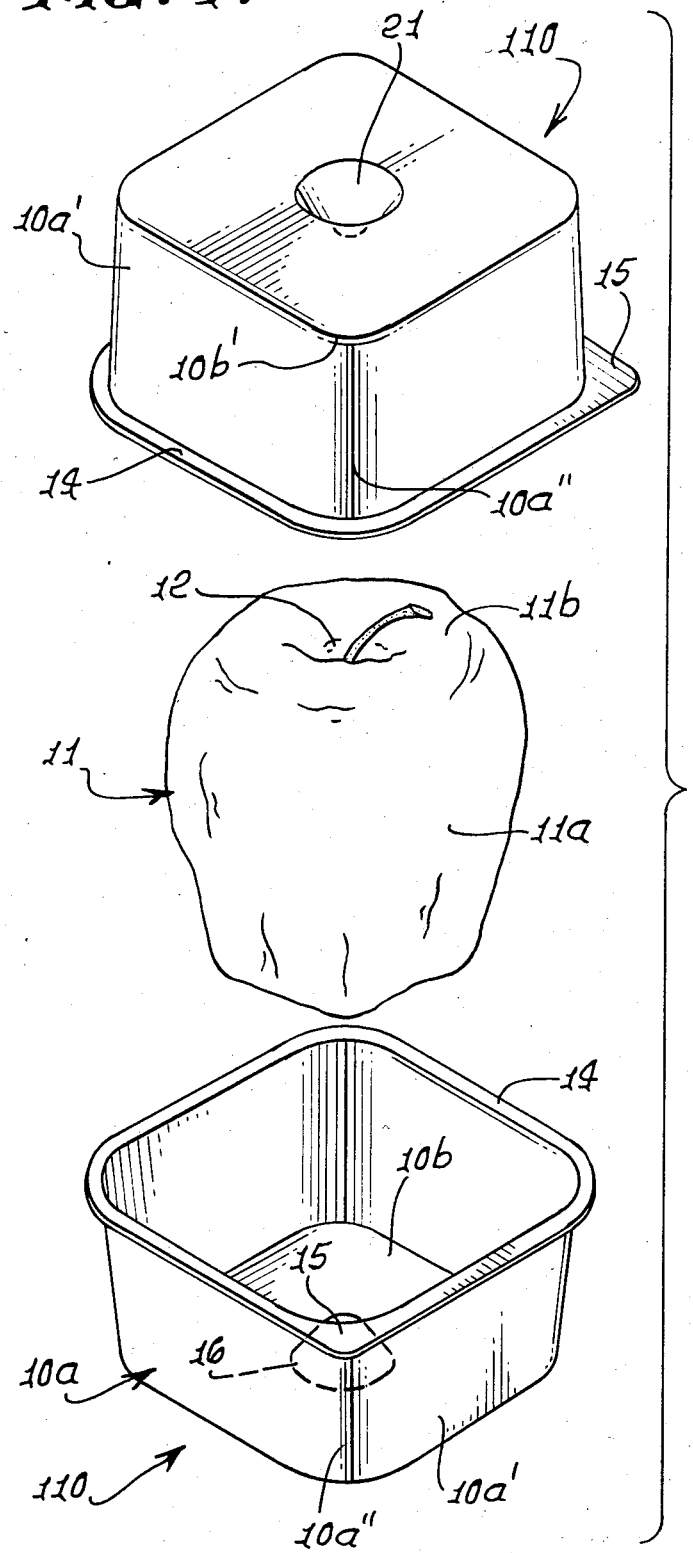
FIG. 4 is an exploded perspective view of the FIG. 1 package.

In accordance with the invention, the package 10 comprises a container or receptacle having upper and lower sections 110, each like having a thin side wall 10*a* and thin bottom wall 10*b*, and consists of molded synthetic resin such as polyethylene or polystyrene, for example. Side wall 10*a*, is shown as generally four-sided, the sides indicated at 10*a'* and joined by convex corner walls 10*a''*. All such walls taper to join the top and bottom walls 10*b* at convex corners 10*b'*. The side walls 10*a'* and corner walls 10*a''* turn outwardly at their rim extents to form peripheral flanges or rims 14 (see FIG. 4), which interfit in matching relation, and which are joined together as by suitable adhesive. A corner portion 15 of each flange projects outwardly to be manually grasped for tear apart of the sections to gain access to the interior of the container. Note that the projections may extend in opposite directions, at opposite sides of the package, for grasping by both hands, to effect the container section separation.

In accordance with the invention, first locating means is provided on the container lower section to project upwardly into said recess, thereby to position the lower extent of the fruit, limiting its sideward movement relative to the container. Also, second locating means is provided on the container upper section to engage the upper extent of the fruit, thereby to position same limiting its sideward movement relative to the container.

As shown in the example, the first locating means may be molded integrally with bottom wall 10*b*, to comprise a part of that wall. It takes the form of a centrally located, generally conical projection 16 having a smoothly domed top surface 16*a* so as not to injure the apple when received relatively upwardly in apple bottom recess 13, to seat or support, and centrally locate the apple in spaced relation to the container side walls. See space 17 between the side of the apple and the container walls.

The second locating means is indicated generally at 21 as located between the top wall 10*b* and the top surface 11*b* of the apple, and characterized as protectively retaining the apple in position, vertically, relative to and spaced from the container side walls 10*a* and the top wall 10*b*. For this purpose, the locating means 21 may be generally conical having a smoothly domed lower surface 35 and it may center the top of the apple in the container upper section. Walls 10*b* may be slightly deflected, i.e. tensioned, to hold the apple in position.

As is clear, the apple is completely protected by the described package, and only the re-entrant surfaces of the apple are engaged, but in a protective manner. The package may be transported, with force application to it, without injuring the apple, since the apple is spaced from the container side walls, and resiliently suspended between and spaced from the annular top and bottom walls 10*b*. In use, the container sections are easily pulled apart to drop out the apple.

Figure 1A:
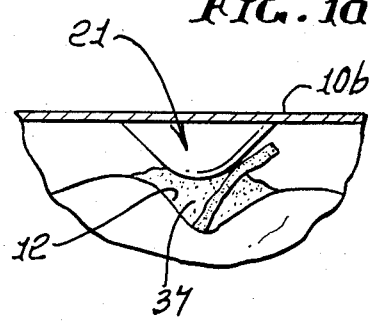
FIG. 1*a* is a fragmentary section.
Figure 2:
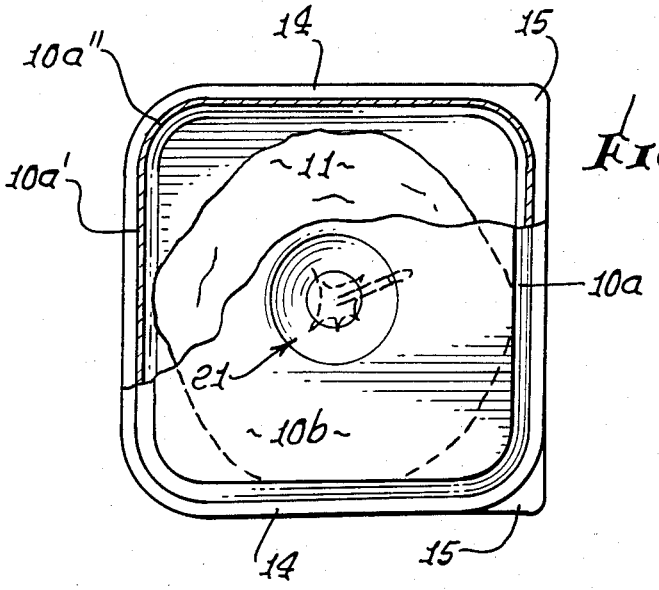
FIG. 2 is a top plan view on lines 2—2 of FIG. 1.
Figure 3:
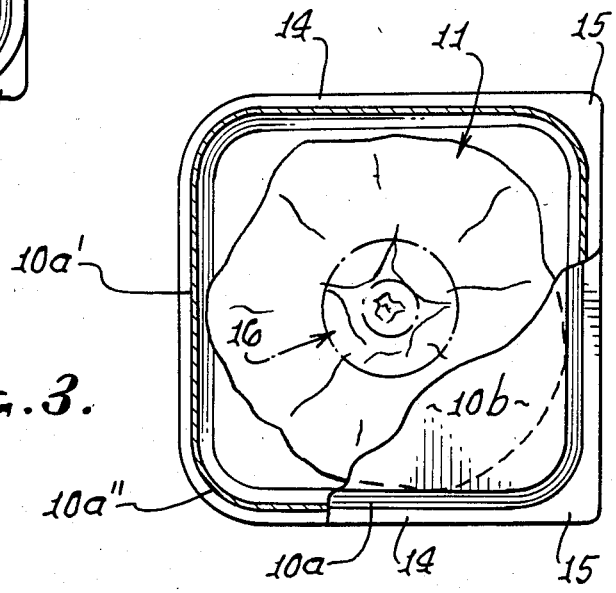
FIG. 3 is a bottom plan view on lines 3—3 of FIG. 1.

In FIG. 1*a* the elements are the same, except that a crushable filler sheet of pad 37 is inserted between projection 21 and the re-entrant surface 12, to act as a spacer for apples of slightly smaller size. Spacer 37 may be located between the lower projection 16, and 13.

Figure 5:
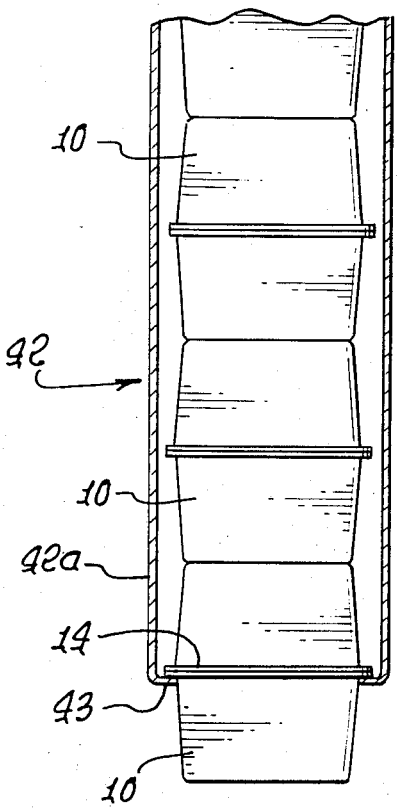
FIG. 5 is a side elevation showing a packaged fruit dispenser.

In FIG. 5, a dispenser 42 dispenses a stack of the packages 10, one at a time. For example, the dispenser tube 42*a* receives the stacked packages 10, and guides their vertical downward movement, as the lowermost package is manually removed. A lip or lips 43 on the dispenser, or equivalent means, supports the package, as at flange or flanges 14, to allow tilting of the package, dislodging it from the flange or flanges and allowing pull-out removal of the package.

I claim:

1. In a package for fresh fruit characterized as having a lower surface forming an upward, reentrant recess, the combination comprising (a) upper and lower container sections to receive said fruit, (b) first locating means on the container lower section to project upwardly into said recess, thereby to position the lower extent of the fruit, limiting its sideward movement relative to the container, (c) and second locating means on the container upper section to engage the upper extent of the fruit, thereby to position same limiting its sideward movement relative to the container, (d) each container section being cup-shaped and having a thin side wall and thin end wall and consisting of synthetic resin, the side wall comprising four substantially flat side wall portions joined by four outwardly convex corner wall portions, all such wall portions of each section tapering to join the end wall at outwardly convex corners, the side wall portions and corner wall portions also turning outwardly to form a continuous peripheral flange, extending about a container section mouth, said flanges being joined, (e) each flange having a projecting corner tab adapted to be grasped and pulled to tear apart the sections, (f) said container section wall portions being sized to closely surround said fruit, in spaced relation thereto, said second locating means having a centrally located conical projection to downwardly enter a re-entrant recess defined by the upper extent of said fruit, said projection having a downwardly domed convex terminus, and said first locating means having a centrally located, generally conical projection to upwardly enter said upwardly re-entrant recess, said projection having an upwardly domed convex terminus.

2. The combination of claim 1 including said fruit in the container sections and positioned therein by said first and second locating means, in closely spaced relation to container walls surrounding the fruit.

3. The combination of claim 2 wherein said fruit consists of an apple.

4. The combination of claim 1 wherein said flanges extend in parallel planes which are generally normal to a central axis defined by the sections.

5. The combination of claim 1 wherein said tabs project in different directions.

6. The combination of claim 1 wherein said first locating means projection is integral with a bottom wall defined by the container lower section.

7. The combination of claim 6 wherein the second locating means projection is integral with a top wall defined by the container upper section.

8. The combination of claim 1 including a dispenser receiving a stack of said packages, for successive dispensing.

9. The combination of claim 8 wherein said dispenser comprises an upright tube and has a lower opening via which said packages are dispensed, the lowermost package supported by the dispenser until it is manually removed from beneath the next above package.

10. The combination of claim 1 including a spacer inserted between one of said locating means and the fruit.

* * * * *